US010920773B2

(12) United States Patent
Isoda

(10) Patent No.: US 10,920,773 B2
(45) Date of Patent: Feb. 16, 2021

(54) VARIABLE OIL PUMP

(71) Applicant: AISIN SEIKI KABUSHIKI KAISHA, Kariya (JP)

(72) Inventor: Atsuo Isoda, Toyoake (JP)

(73) Assignee: AISIN SEIKI KABUSHIKI KAISHA, Kariya (JP)

( * ) Notice: Subject to any disclaimer, the term of this patent is extended or adjusted under 35 U.S.C. 154(b) by 296 days.

(21) Appl. No.: 15/756,227

(22) PCT Filed: Aug. 19, 2016

(86) PCT No.: PCT/JP2016/074277
§ 371 (c)(1),
(2) Date: Feb. 28, 2018

(87) PCT Pub. No.: WO2017/051645
PCT Pub. Date: Mar. 30, 2017

(65) Prior Publication Data

US 2018/0245588 A1 Aug. 30, 2018

(30) Foreign Application Priority Data

Sep. 24, 2015 (JP) ..... 2015-186541

(51) Int. Cl.
*F04C 14/22* (2006.01)
*F04C 15/00* (2006.01)
(Continued)

(52) U.S. Cl.
CPC ..... *F04C 14/226* (2013.01); *F01C 21/0863* (2013.01); *F01M 1/16* (2013.01);
(Continued)

(58) Field of Classification Search
CPC . F01C 21/0863; F01M 1/16; F04C 2270/185; F04C 2/10; F04C 2/102;
(Continued)

(56) References Cited

U.S. PATENT DOCUMENTS

2015/0354564 A1* 12/2015 Takahashi ..... F04C 13/002 418/19
2017/0241416 A1 8/2017 Yamamoto et al.

FOREIGN PATENT DOCUMENTS

JP 2014-159761 A 9/2014

OTHER PUBLICATIONS

International Search Report (PCT/ISA/210) dated Nov. 15, 2016, by the Japanese Patent Office as the International Searching Authority for International Application No. PCT/JP2016/074280.
(Continued)

*Primary Examiner* — Mary Davis
*Assistant Examiner* — Paul W Thiede
(74) *Attorney, Agent, or Firm* — Buchanan Ingersoll & Rooney PC

(57) ABSTRACT

A variable oil pump includes a pump housing, a cover, an oil pump rotor rotationally driven while housed in a housing space between the pump housing and the cover, an adjustment member housed in the housing space to adjust the amount of oil discharged from the oil pump rotor by being displaced due to a drive force while rotatably holding the oil pump rotor from an outer peripheral side, and a guide portion including a groove in the adjustment member and a pin on the pump housing that engage one another. Engagement of the pin and the groove guides displacement of the adjustment member relative to the pump housing. A seal structure on at least one of the pump housing and the cover seals the inside of the groove relative to the housing space by surrounding a movement trajectory of the groove relative to the pin.

6 Claims, 4 Drawing Sheets

(51) Int. Cl.
*F01C 21/08* (2006.01)
*F01M 1/16* (2006.01)
*F04C 2/10* (2006.01)

(52) U.S. Cl.
CPC ..... *F04C 2/10* (2013.01); *F04C 2/102* (2013.01); *F04C 15/0026* (2013.01); *F04C 2210/206* (2013.01); *F04C 2270/185* (2013.01)

(58) Field of Classification Search
CPC .. F04C 14/18; F04C 14/223; F04C 2210/206; F04C 2240/30; F04C 2240/10; F04C 15/0026; F04C 14/226
USPC ..... 418/19, 22, 24, 26–27, 30, 166, 171
See application file for complete search history.

(56) References Cited

OTHER PUBLICATIONS

Written Opinion (PCT/ISA/237) dated Nov. 15, 2016, by the Japanese Patent Office as the International Searching Authority for International Application No. PCT/JP2016/074280.
International Search Report (PCT/ISA/210) dated Nov. 15, 2016, by the Japanese Patent Office as the International Searching Authority for International Application No. PCT/JP2016/074277.
Written Opinion (PCT/ISA/237) dated Nov. 15, 2016, by the Japanese Patent Office as the International Searching Authority for International Application No. PCT/JP2016/074277.
U.S. Appl. No. 15/756,121, filed Feb. 28, 2018, Yuki Nishida.
U.S. Appl. No. 15/756,161, dated Feb. 28, 2018, Yuki Nishida.

* cited by examiner

CROSS-SECTION TAKEN ALONG LINE 160-160
(CROSS-SECTION TAKEN ALONG LINE 150-150)

FIG.5
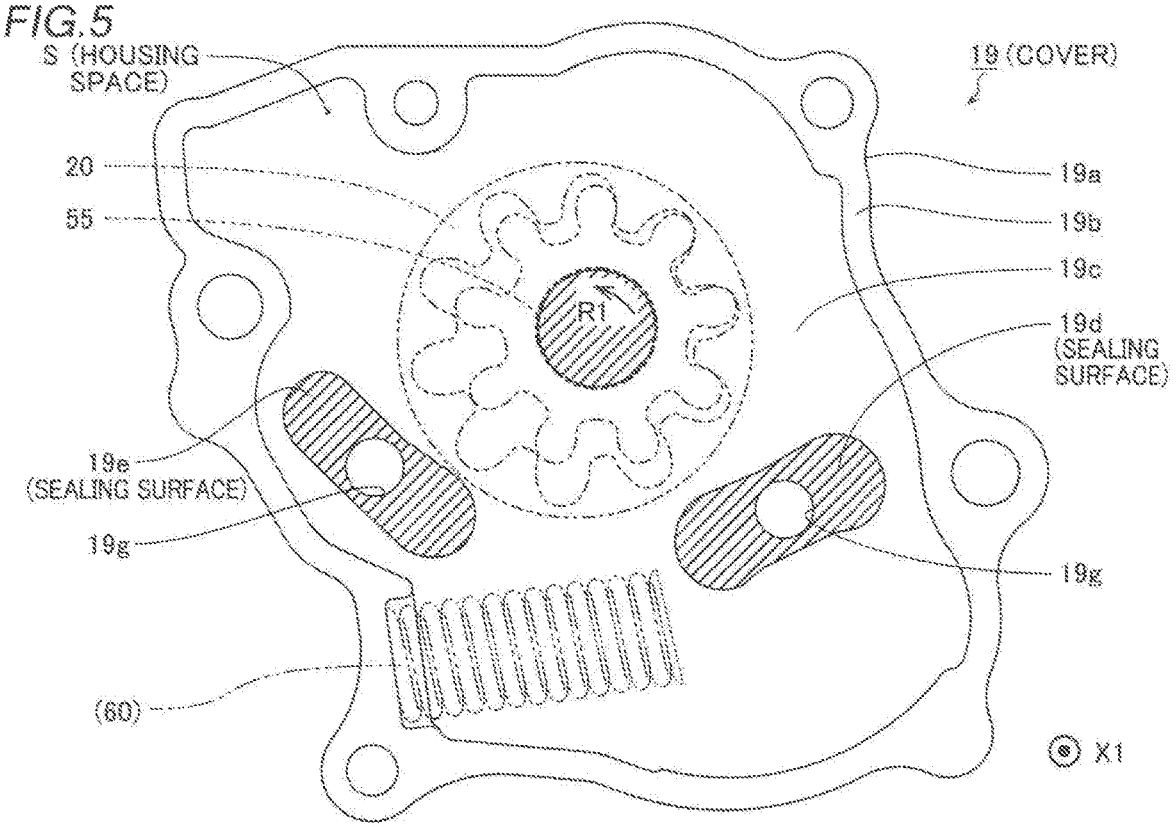
FIG.6 MOVEMENT TRAJECTORIES OF GUIDE HOLES 38 AND 39 CAUSED BY ROTATION OF ADJUSTMENT RING 30
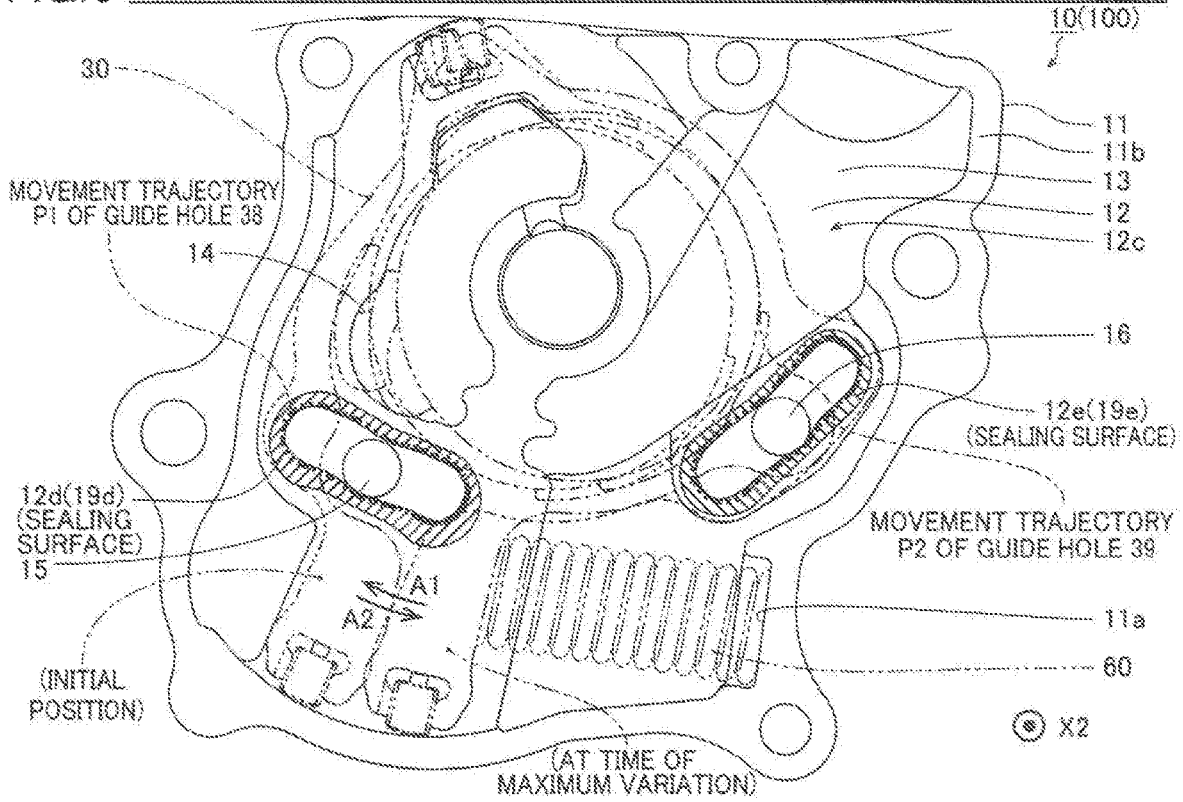

VARIABLE OIL PUMP

TECHNICAL FIELD

The present invention relates to a variable oil pump.

BACKGROUND ART

In general, a variable oil pump including a pump housing, a cover, and an adjustment member that adjusts the oil discharge amount is known. Such a variable oil pump is disclosed in Japanese Patent Laying-Open No. 2014-159761, for example.

Japanese Patent Laying-Open No. 2014-159761 discloses a hydraulic controller that controls an oil pump (variable oil pump) including a variable displacement mechanism. The oil pump, the capacity of which is controlled by the hydraulic controller, described in Japanese Patent Laying-Open No. 2014-159761 includes a concave housing, a cover that covers the housing, a driven rotor (oil pump rotor) housed in an interior housing space formed by covering the housing with the cover, and an adjustment ring (adjustment member) that rotatably holds the driven rotor from the outer peripheral side in the housing space. The adjustment ring is displaced due to hydraulic pressure, and hence the rotational center of the driven rotor with respect to the rotational center of a drive rotor is moved such that the discharge amount per rotation of the oil pump can be increased and decreased. Incidentally, a guide pin that protrudes from the bottom of the housing engages with a guide hole (groove) formed in the adjustment ring, and the trajectory of rotation of the adjustment ring is defined along the movement trajectory of the guide hole that engages with the guide pin. Furthermore, the guide hole is filled with oil in the oil pump such that the guide hole of the adjustment ring smoothly slides (swings) with respect to the guide pin.

PRIOR ART

Patent Document

Patent Document 1: Japanese Patent Laying-Open No. 2014-159761

SUMMARY OF THE INVENTION

Problem to be Solved by the Invention

However, in the oil pump (variable oil pump) described in Japanese Patent Laying-Open No. 2014-159761, there is a problem that when foreign matter contained in the oil flows into the guide hole (groove) of the adjustment ring during operation of the oil pump, this foreign matter becomes an obstacle, and the smooth mobility of the guide hole (adjustment member) with respect to the guide pin is impeded. That is, when the foreign matter is stuck in a gap between the guide pin and the guide hole, the guide hole (adjustment ring) is locked or the foreign matter itself damages the inner surface of the guide hole, for example, such that the normal rotational movement (swinging) of the adjustment ring may be impaired when the capacity is variable.

In order to attain the aforementioned object, a variable oil pump according to an aspect of the present invention includes a pump housing, a cover that faces the pump housing, an oil pump rotor rotationally driven while being housed in a housing space between the pump housing and the cover, an adjustment member housed in the housing space and that adjusts an amount of oil discharged from the oil pump rotor by being displaced due to a drive force while rotatably holding the oil pump rotor from an outer peripheral side, a guide portion including a groove provided in the adjustment member and a pin provided on the pump housing and that engages with the groove, and the guide portion that guides relative displacement of the adjustment member with respect to the pump housing by engaging the groove and the pin with each other, and a seal structure provided on at least one of the pump housing and the cover and that seals an inside of the groove with respect to the housing space by surrounding a movement trajectory of the groove of the adjustment member relatively displaced with respect to the pin.

As hereinabove described, the variable oil pump according to this aspect of the present invention includes the seal structure provided on at least one of the pump housing and the cover and that seals the inside of the groove with respect to the housing space between the pump housing and the cover by surrounding the movement trajectory of the groove of the adjustment member relatively displaced with respect to the pin. Thus, even when foreign matter contained in oil flows into the variable oil pump (the housing space between the pump housing and the cover) during operation of the variable oil pump, the inside of the groove of the guide portion that holds the pin can be sealed with respect to the housing space, and hence it is possible to prevent the foreign matter from entering the guide portion (groove). Consequently, the foreign matter is prevented from being trapped in the guide portion (groove), and hence it is possible to significantly reduce or prevent inhibition of the smooth operation (displacement) of the adjustment member due to the foreign matter that has flowed into the variable oil pump.

In the aforementioned variable oil pump according to this aspect, the seal structure is preferably circumferentially provided on a region portion corresponding to the movement trajectory of the groove in an inner surface of the pump housing.

According to this structure, the inside of the groove of the guide portion can be continuously sealed with respect to the housing space along the movement trajectory of the groove of the adjustment member, and hence it is possible to reliably prevent the foreign matter that has been mixed (has flowed) into the housing space between the pump housing and the cover during operation of the variable oil pump from entering the guide portion (the groove of the adjustment member during displacement).

In the aforementioned structure in which the seal structure is circumferentially provided on the region portion corresponding to the movement trajectory of the groove in the inner surface of the pump housing, the seal structure is preferably circumferentially provided on a region portion corresponding to the movement trajectory of the groove in an inner surface of the cover in addition to the region portion of the pump housing.

According to this structure, in addition to the inner surface of the pump housing, the inner surface of the cover and the guide portion (groove) can be further continuously sealed. Therefore, the sealing property (sealability) between the groove and the housing space can be further increased on both the pump housing side and the cover side, and hence it is possible to more reliably prevent the foreign matter that has been mixed (has flowed) into the housing space from entering the guide portion (groove).

In this case, the seal structure on the pump housing and the seal structure on the cover preferably overlap each other with a same shape in a planar view.

According to this structure, regardless of how the adjustment member is displaced (rotates), both the sealing property (sealability) between the guide portion (groove) and the pump housing and the sealing property (sealability) between the guide portion (groove) and the cover can be kept. Along with this, the adjustment member that is displaced (rotates) while being sandwiched between the sealing surfaces can be securely held in the housing space.

In the aforementioned variable oil pump according to this aspect, the seal structure preferably seals the inside of the groove with respect to the housing space by bringing a flat inner surface of at least one of the pump housing and the cover and an outer edge of the groove in the adjustment member into surface contact with each other.

According to this structure, even when the outer edge of the groove in the adjustment member moves together with the displacement (rotation) of the adjustment member, the internal space of the groove can be reliably isolated from the housing space by the seal structure in which the flat inner surface and the outer edge of the groove come into surface contact with each other, using a wider sealing area, unlike the case where the outer edge of the groove in the adjustment member simply comes into line contact with the flat inner surface of at least one of the pump housing and the cover. Therefore, it is possible to easily prevent the foreign matter in the housing space between the pump housing and the cover from entering the guide portion (groove) during operation of the variable oil pump.

In the aforementioned variable oil pump according to this aspect, a flat inner surface of at least one of the pump housing and the cover preferably surrounds the movement trajectory of the groove while extending to a region outside an outer edge of the groove in the adjustment member.

According to this structure, the outer edge of the groove on one side can reliably come into surface contact with the flat inner surface of the cover, and the outer edge of the groove on the other side (opposite side) can reliably come into surface contact with the flat inner surface of the housing.

BRIEF DESCRIPTION OF THE DRAWINGS

FIG. 5 A plan view showing a cover of the variable oil pump according to the embodiment of the present invention, as viewed from the inside.

FIG. 6 A diagram showing the movement trajectory of an adjustment ring of the variable oil pump according to the embodiment of the present invention.

MODES FOR CARRYING OUT THE INVENTION

An embodiment of the present invention is hereinafter described on the basis of the drawings.

Embodiment

The configuration of a variable oil pump 100 according to the embodiment of the present invention is now described with reference to FIGS. 1 to 7.

(Overall Configuration of Variable Oil Pump)

Figure 1:
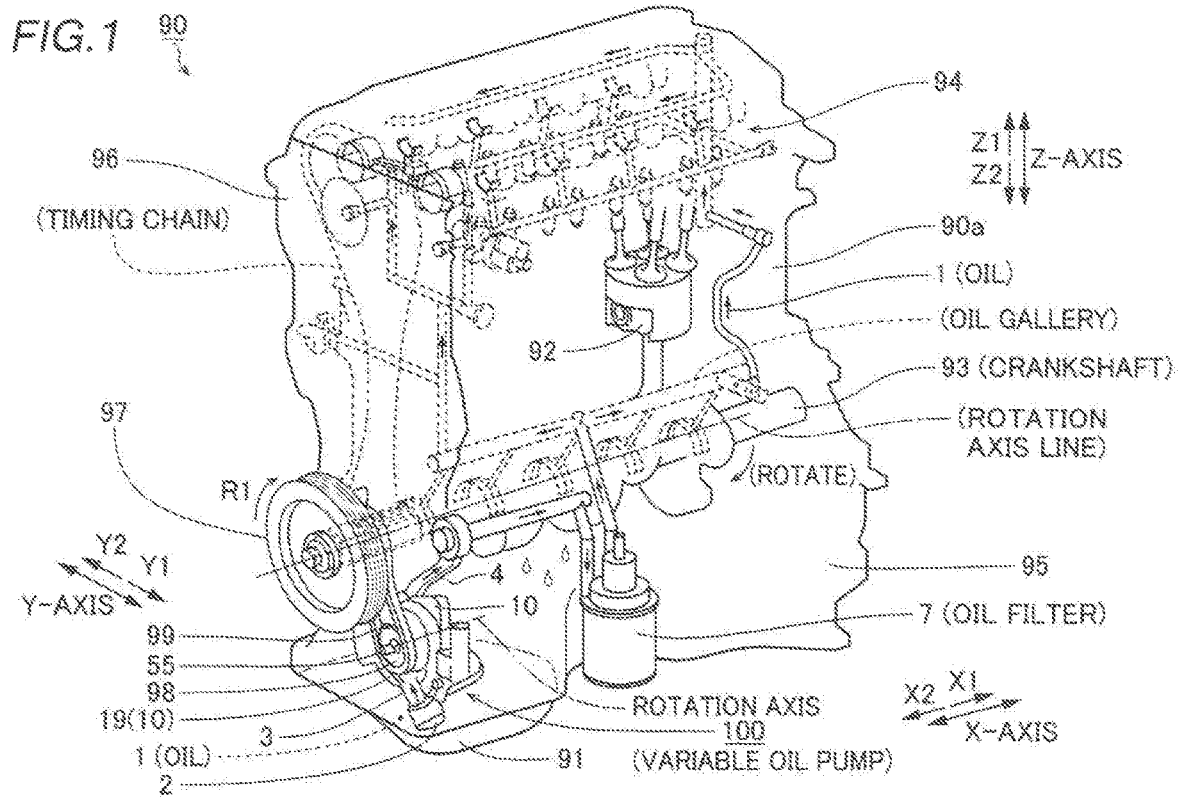
FIG. 1 A diagram showing an engine mounted with a variable oil pump according to an embodiment of the present invention.

As shown in FIG. 1, the variable oil pump 100 according to the embodiment of the present invention is mounted on an automobile (not shown) including an engine 90. The variable oil pump 100 has a function of pumping oil (engine oil) 1 in an oil pan 91 to movable portions (sliding portions) such as a plurality of pistons 92, a crankshaft 93, and a valve mechanism 94.

Figure 2:
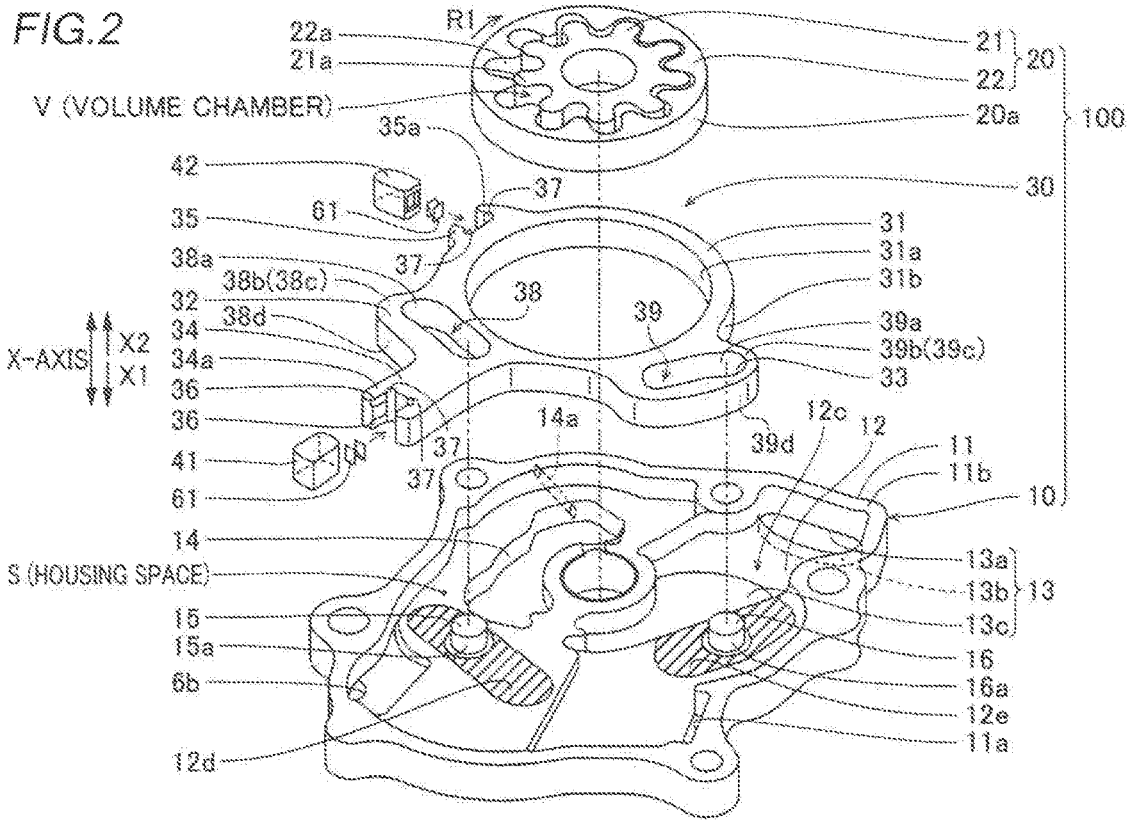
FIG. 2 An exploded perspective view showing the structure of the variable oil pump according to the embodiment of the present invention.

As shown in FIG. 2, the variable oil pump 100 includes a housing 10, a pump rotor (oil pump rotor) 20 rotatably provided in the housing 10, an adjustment ring 30 (an example of an adjustment member) that rotatably holds the pump rotor 20 from the outer peripheral side, a coil spring 60 (see FIG. 3) that urges the adjustment ring 30 toward its initial position, and a cover 19 (see FIG. 1) that covers the housing 10 in an arrow X1 direction from an X2 side. The pump rotor 20 includes an inner rotor 21 of an external gear and an outer rotor 22 of an internal gear.

Figure 3:
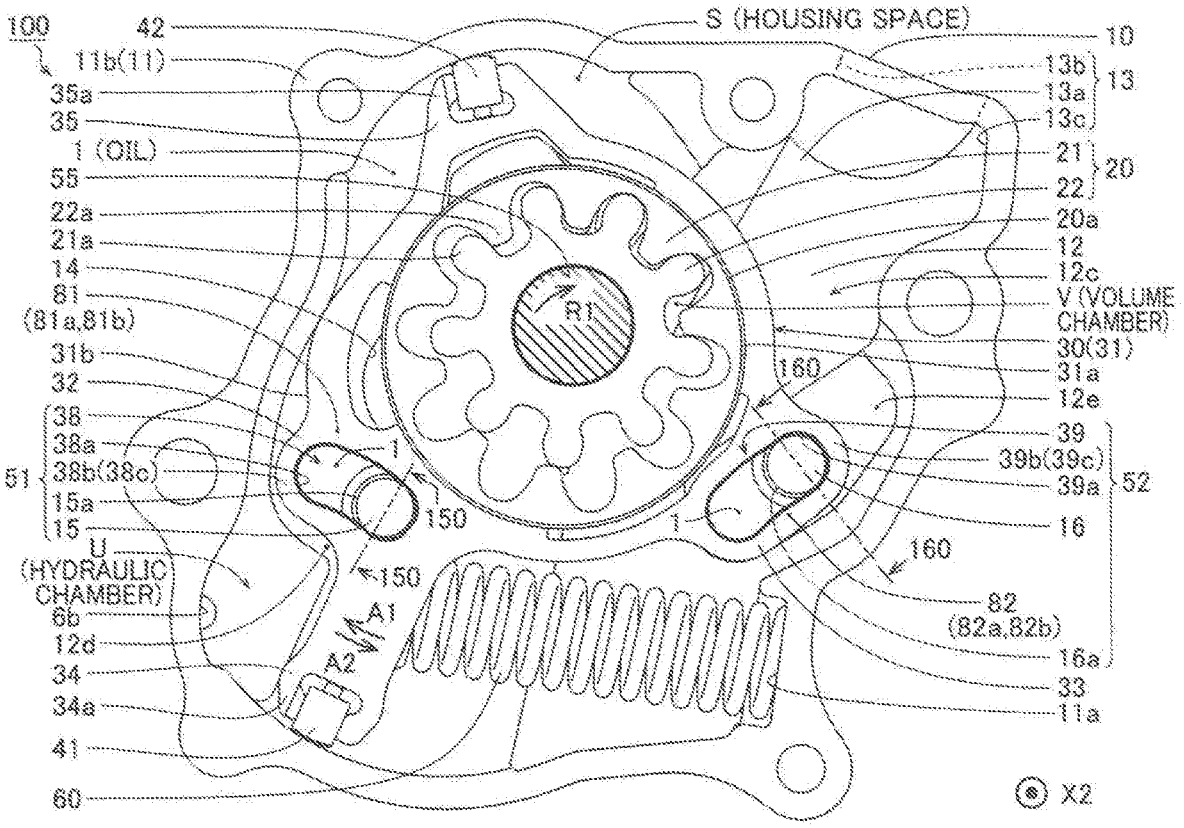
FIG. 3 A plan view showing the internal structure of the variable oil pump according to the embodiment of the present invention.

As shown in FIG. 3, the rotational center of the inner rotor 21 is decentered by a fixed amount with respect to the rotational center of the outer rotor 22. When the inner rotor 21 rotates in an arrow R1 direction (clockwise direction), the inner rotor 21 rotates with a slight delay in the same direction. At the time of rotation, in a portion where a distance between the inner rotor 21 and the outer rotor 22 is short, external teeth 21*a* of the inner rotor 21 mesh with internal teeth 22*a* of the outer rotor 22. On the other hand, in a portion where the distance is long, the number of the external teeth 21*a* of the inner rotor 21 is one less than the number of the internal teeth 22*a* of the outer rotor 22, and hence a volume chamber V is gradually formed between the inner rotor 21 and the outer rotor 22. Furthermore, the volume chamber V expands and contracts as the pump rotor 20 rotationally moves in the arrow R1 direction such that a pumping function is created in the pump rotor 20.

The external teeth 21*a* of the inner rotor 21 each have a tooth profile in which the tooth width is narrowed and the tooth length is stretched radially outward as compared with external teeth of an inner rotor in a common trochoid pump. Furthermore, the internal teeth 22*a* of the outer rotor 22 match the tooth profile of the external teeth 21*a* to be able to mesh therewith. Thus, a larger volume of the volume chamber V formed in the pump rotor 20 is ensured.

As shown in FIG. 1, the variable oil pump 100 is disposed obliquely downward (on a Z2 side) with respect to the crankshaft 93 inside a crankcase 95. In the engine 90, a vertically long chain cover (timing chain cover) 96 is fastened to a side end surface on the X2 side of an engine block 90*a* including the crankcase 95, and a region (Z2 side) of a lower end of the chain cover 96 is fastened to a side end surface of the oil pan 91 in the crankcase 95. An end of the crankshaft 93 on the X2 side is exposed to the outside (X2 side) via an oil seal (not shown) fitted into a through-hole of the chain cover 96, and a crank pulley 97 is attached to this portion.

Accordingly, the variable oil pump 100 is disposed inside the chain cover 96, and a timing chain 99 is wound around the crankshaft 93 and a sprocket 98 on the side of an input shaft 55. The drive force of the crankshaft 93 is transmitted to the input shaft 55 via the timing chain 99 and the sprocket 98 both for driving the oil pump, and the pump rotor 20 is rotated by the input shaft 55 pressed into the inner rotor 21.

(Detailed Configuration of Variable Oil Pump)

As shown in FIG. 2, the housing 10 is a concave (deep dish-shaped) casting of an aluminum alloy, and includes a circumferential wall 11 that surrounds the outer edge of the housing 10 and a bottom 12 that connects the wall 11. Furthermore, in a state where the pump rotor 20, the adjustment ring 30, and the coil spring 60 (see FIG. 3) are housed in a concave housing recess 12*c* defined by the wall 11 and the bottom 12 in a predetermined positional relationship, the cover 19 (see FIG. 1) is attached. In addition, the housing 10 is provided with a suction port 13 through which the oil 1 (see FIG. 1) is suctioned and a discharge port 14 through which the oil 1 (see FIG. 1) is discharged.

Whereas the suction port 13 is connected to a pipe 3 (see FIG. 6) connected to an oil strainer 2 via an oil passage 13*b* inside the housing 10 from an opening 13*a* opened in the bottom 12, a downstream portion 13*c* is formed in a shallow groove shape by recessing the bottom 12 according to a suction range. The discharge port 14 is formed in a shallow groove shape by recessing the bottom 12 according to a discharge range, and is connected to a discharge oil passage 4 (see FIG. 6) via an oil passage 14*a* inside the housing 10.

The housing 10 includes two pins 15 and 16 that protrude in an X-axis direction from the bottom 12. The pins 15 and 16 include outer surfaces 15*a* and 16*a* circularly formed. The pins 15 and 16 are configured to engage with guide holes 38 and 39 of the adjustment ring 30 described later, respectively. In addition, the cover 19 (see FIG. 1) is fastened to a joint surface 11*b* (an end surface on the X2 side) of the wall 11 of the housing 10 in the arrow X1 direction from the X2 side in FIG. 2 by a fastening member (not shown).

The variable oil pump 100 includes a variable displacement mechanism to change the discharge amount (pump capacity) of the oil 1 discharged every rotation of the pump rotor 20. This variable displacement mechanism is a mechanism that displaces (rotates) the adjustment ring 30 due to the hydraulic pressure (control hydraulic pressure) of a hydraulic chamber U formed in the housing recess 12*c* of the housing 10. The relative positions of the inner rotor 21 and the outer rotor 22 with respect to the suction port 13 and the discharge port 14 are changed due to the displacement (rotation) of the adjustment ring 30, and the pump capacity is changed. The variable displacement mechanism including the adjustment ring 30 is described below in detail.

(Configuration of Variable Displacement Mechanism)

As shown in FIG. 2, the adjustment ring 30 includes a main body 31, overhangs 32 and 33, an operation portion 34, and a protrusion 35. The overhangs 32 and 33, the operation portion 34, and the protrusion 35 are integral with the main body 31. The pump rotor 20 is disposed such that its outer peripheral surface 20*a* smoothly contacts (slides with respect to) the inner peripheral surface 31*a* of the main body 31.

The main body 31 is annular, and has a function of rotatably holding the pump rotor 20 (outer rotor 22) from the outer peripheral side. The outer surface 31*b* of the main body 31 overhangs outward (in an outward radial direction of rotation) such that the overhangs 32 and 33 are formed. The overhang 32 is formed with the elongated hole-shaped guide hole 38 (an example of a groove) that penetrates in a thickness direction (X-axis direction) and is gently curved. In addition, the overhang 33 is formed with the elongated hole-shaped guide hole 39 (an example of a groove) that penetrates in the thickness direction and is gently curved.

The operation portion 34 protrudes from the outer surface 31*b*, and is a portion to which an external force (the hydraulic pressure of the hydraulic chamber U or the urging force of the coil spring 60) is applied when the main body 31 rotates. A vane holding portion 34*a*, which includes a concavely recessed tip, of the operation portion 34 holds a vane 41 via a leaf spring 61. The protrusion 35 protrudes from the outer surface 31*b*, and a vane holding portion 35*a* including a concavely recessed tip holds a vane 42 via a leaf spring 61. The vanes 41 and 42 have substantially the same length as the thickness (a dimension in the X-axis direction) of the adjustment ring 30, and are made of a resin material or the like excellent in wear resistance.

As shown in FIG. 3, the coil spring 60 is fitted into a region where the inner surface 11*a* of the wall 11 faces the operation portion 34 in a state where the adjustment ring 30 is housed in the housing 10. The operation portion 34 is urged in an arrow A1 direction due to the extension force of the coil spring 60. That is, due to the pressing force of the coil spring 60 that acts on the operation portion 34, the adjustment ring 30 is urged so as to be rotated (displaced) in the clockwise direction in FIG. 1 about the input shaft 55. Thus, when the hydraulic pressure does not act on the operation portion 34, the adjustment ring 30 is held at the initial position where the adjustment ring 30 starts to be displaced (rotate) in a state where the coil spring 60 is maximally extended.

In a state where the adjustment ring 30 is housed in the housing 10, the hydraulic chamber U is formed in a region surrounded by the inner surface 11*a* of the wall 11, the vanes 41 and 42, and the outer surface 31*b* (including a portion of the outer surface of the operation portion 34) of the adjustment ring 30 between the vanes 41 and 42.

In a state where the adjustment ring 30 is housed in the housing 10, the pin 15 is slidably inserted into the guide hole 38 and engages therewith, and the pin 16 is slidably inserted into the guide hole 39 and engages therewith. The pin 15 and the guide hole 38 engage with each other, and the pin 16 and the guide hole 39 engage with each other such that guide portions 51 and 52 guide relative displacement (rotation) of the adjustment ring 30 with respect to the housing 10. In other words, the guide portions 51 and 52 restrict a direction in which the adjustment ring 30 rotates to a direction in which the guide holes 38 and 39 extend (the longitudinal direction of the cross-sections of the guide holes 38 and 39).

Figure 4:
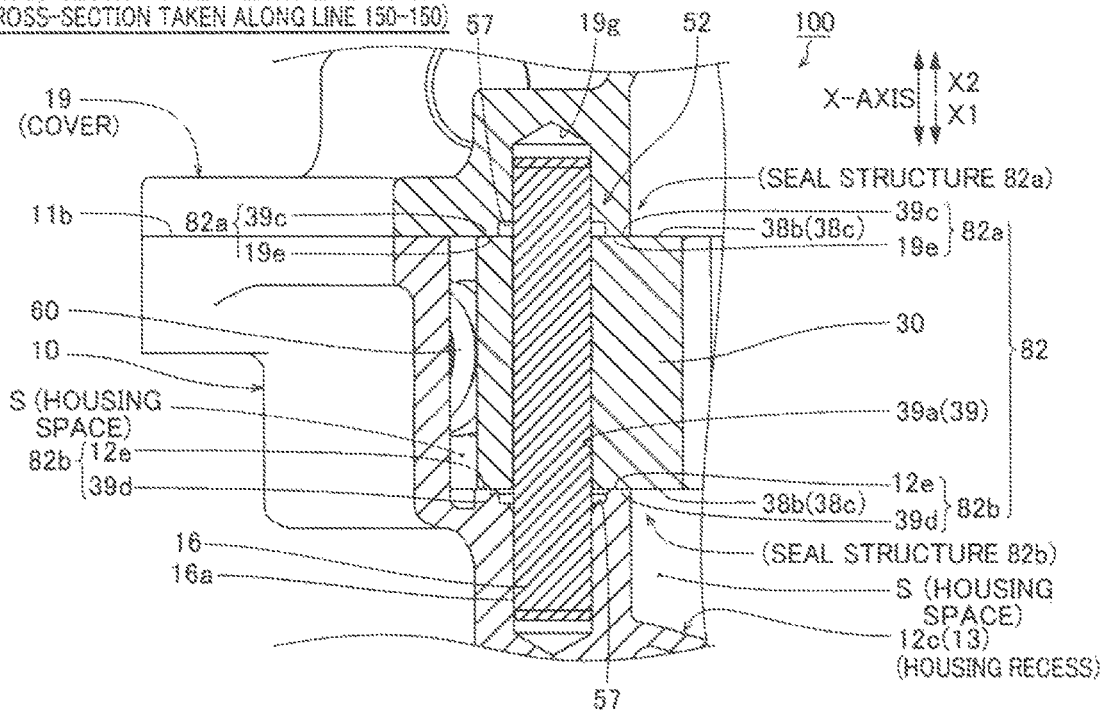
FIG. 4 A sectional view taken along the line 160-160 in FIG. 3.

According to this embodiment, the guide portions 51 and 52 are provided with seal structures 81 and 82, respectively. Specifically, as shown in FIG. 4, the guide portion 52 is provided with a pair of seal structures 82*a* (X2 side) and 82*b* (X1 side) that seal the inside of the guide hole 39 with respect to a housing space S, for example. Although the cross-sectional structure is not shown, the guide portion 51 (see FIG. 3) is similarly provided with a seal structure 81*a* (X2 side) and a seal structure 81*b* (X1 side) that seal the inside of the guide hole 38 with respect to the housing space S. Note that the seal structures 81*a* and 81*b* and the seal structures 82*a* and 82*b* differ only in their formed positions and have the same configuration and function as each other. Therefore, the seal structures 82*a* and 82*b* shown in FIG. 4 continue to be described as representatives.

(Description of Seal Structure)

As shown in FIG. 2, on the periphery of a portion where the pin 15 is provided and the periphery of a portion where the pin 16 is provided in the housing recess 12*c* of the housing 10, flat (hatched regions) sealing surfaces 12*d* and 12*e* (examples of a region portion and a flat inner surface) each having an oval shape are formed, respectively. As shown in FIG. 5, the cover 19 is a concave casting of an aluminum alloy, and includes a circumferential wall 19*a* including a joint surface 19*b* that surrounds the outer edge of the cover 19 and an inner bottom 19*c* that connects the wall 19*a*. Around recesses 19*g* of the inner bottom 19*c* into which the tips of the pins 15 and 16 (see FIG. 2) are inserted, flat (hatched regions) sealing surfaces 19*d* and 19*e* (examples of a region portion and a flat inner surface) each having an oval shape are formed, respectively.

As shown in FIGS. 3 and 4, the outer edge 38*b* (39*b*) of the guide hole 38 (39) in the adjustment ring 30 is formed with a sealing surface 38*c* (39*c*) (an example of an outer edge of the groove) including a flat surface annularly formed with a predetermined width along the outer edge 38*b* (39*b*) and located on the X2 side and a sealing surface 38*d* (39*d*) (an example of an outer edge of the groove) including a flat surface in the same manner and located on the X1 side. As shown in FIG. 4, in a state where the adjustment ring 30 is incorporated in the housing 10 and the cover 19 is fastened, the sealing surface 19*e* of the cover 19 faces the sealing surface 39*c* (X2 side) of the adjustment ring 30 with a clearance (in the X-axis direction) of about 25 μm or more and about 75 μm or less, and the sealing surface 12*e* of the housing 10 faces the sealing surface 39*d* (X1 side) of the adjustment ring 30 with a clearance (in the X-axis direction) of about 25 μm or more and about 75 μm or less.

Although FIG. 4 shows the cross-sectional structure of the guide portion 52 taken along the line 160-160 in FIG. 3, the cross-sectional structure of the guide portion 51 taken along the line 150-150 in FIG. 3 is substantially the same as the cross-sectional structure shown in FIG. 4. That is, the sealing surface 19*d* (see FIG. 5) of the cover 19 faces the sealing surface 38*c* (see FIG. 2) of the adjustment ring 30 on the X2 side with a clearance (in the X-axis direction) of about 25 μm or more and about 75 μm or less, and the sealing surface 12*d* (see FIG. 2) of the housing 10 faces the sealing surface 38*d* (see FIG. 2) of the adjustment ring 30 on the X1 side with a clearance (in the X-axis direction) of about 25 μm or more and about 75 μm or less.

The sealing surfaces 12*d* (see FIG. 3) and 19*d* (see FIG. 5) of the guide portion 51 overlap each other with the same shape in a planar view as viewed in the X-axis direction. Similarly, the sealing surfaces 12*e* and 19*e* of the guide portion 52 (see FIG. 4) overlap each other with the same shape in a planar view as viewed in the X-axis direction.

As shown in FIG. 6, regions where the sealing surfaces 12*d* and 19*d* are formed each have a planar shape that completely covers the movement trajectory P1 (a region shown by a thick two-dot chain line) of the guide hole 38 (sealing surfaces 38*c* and 38*d*) of the rotating adjustment ring 30. Similarly, regions where the sealing surfaces 12*e* and 19*e* are formed each have a planar shape that completely covers the movement trajectory P2 (a region shown by a thick two-dot chain line) of the guide hole 39 (sealing surfaces 39*c* and 39*d*) of the rotating adjustment ring 30. The flat sealing surface 19*d* (19*e*) of the cover 19 and the flat sealing surface 12*d* (12*e*) of the housing 10 surround the movement trajectory P1 (P2) of the guide hole 38 (39) while extending to a region outside the outer edge 38*b* (39*b*) of the guide hole 38 (39) in the adjustment ring 30.

Although FIG. 6 shows the sealing surfaces 12*d* and 12*e* (19*d* and 19*e*) as if the sealing surfaces 12*d* and 12*e* (19*d* and 19*e*) spread outward from the movement trajectories P1 and P2 and each have an annular (oval) shape for convenience of illustration, the sealing surfaces 12*d* and 12*e* (19*d* and 19*e*) themselves actually are flat surfaces that uniformly extend from the outside of the movement trajectories P1 and P2 (see FIG. 6) to the vicinities of the pins 15 and 16, as shown in FIGS. 2 and 5. Therefore, as shown in FIG. 6, regardless of where the adjustment ring 30 is located within the range of the movement trajectory P1 (P2), the sealing surfaces 38*c* and 38*d* (39*c* and 39*d*) of the adjustment ring 30 and the sealing surfaces 19*d* and 12*d* (19*e* and 12*d*) maintain the sealed state of the guide hole 38 (39).

Therefore, according to this embodiment, as shown in FIG. 4, the seal structure 82*a* provided on the X2 side is circumferentially formed around the guide hole 39 by the sealing surface 19*e* of the cover 19 and the sealing surface 39*c* of the guide hole 39, and the seal structure 82*b* provided on the X1 side is circumferentially formed around the guide hole 39 by the sealing surface 12*e* of the housing 10 and the sealing surface 39*d* of the guide hole 39. As shown in FIG. 3, the seal structure 81*a* provided on the X2 side (the front side of the plane of the figure) is circumferentially formed around the guide hole 38 by the sealing surface 19*d* of the cover 19 and the sealing surface 38*c* of the guide hole 38, and the seal structure 82*a* provided on the X1 side (the rear side of the plane of the figure) is circumferentially formed around the guide hole 38 by the sealing surface 12*d* of the housing 10 and the sealing surface 38*d* of the guide hole 38.

Thus, as shown in FIG. 4, the sealing surface 19*e* of the cover 19 and the sealing surface 39*c* of the guide hole 39 come into surface contact with each other on the movement trajectory P2 (see FIG. 6) in the seal structure 82*a*, and the sealing surface 12*e* of the housing 10 and the sealing surface 39*d* of the guide hole 39 come into surface contact with each other on the movement trajectory P2 (see FIG. 6) in the seal structure 82*b*. Therefore, the inside of the guide hole 39 is sealed with respect to the housing space S regardless of the presence or absence of displacement (rotation) of the adjustment ring 30. Similarly, the sealing surface 19*d* of the cover 19 and the sealing surface 38*c* of the guide hole 38 come into surface contact with each other on the movement trajectory P1 (see FIG. 6) in the seal structure 81*a* (see FIG. 3), and the sealing surface 12*d* of the housing 10 and the sealing surface 38*d* of the guide hole 38 come into surface contact with each other on the movement trajectory P1 (see FIG. 6) in the seal structure 81*b* (see FIG. 3). Therefore, the inside of the guide hole 38 is sealed with respect to the housing space S regardless of the presence or absence of displacement (rotation) of the adjustment ring 30 in the arrow A1 (A2) direction.

As shown in FIG. 3, the guide hole 38 (39) is filled with the oil 1. Furthermore, in this state, the guide hole 38 (39) rotates in the arrow A1 direction or an arrow A2 direction with respect to the pin 15 (16). Therefore, as shown in FIG. 4, groove-shaped oil passages 57 (two places on the X1 side and the X2 side) where the oil 1 internally filled can move (breathe) from a space on one side to a space on the other side as the guide hole 39 (38) moves with respect to the pin 16 (15) are formed on the inner edge of the sealing surface 19*e* (19*d*) of the cover 19.

Therefore, even when foreign matter contained in the oil 1 (see FIG. 1) flows into the variable oil pump 100 (the housing space S between the housing 10 and the cover 19) during operation of the variable oil pump 100, the inside of the guide hole 38 (39) of the guide portion 51 (52) that holds the pin 15 (16) is isolated from the housing space S by the seal structures 81*a* and 81*b* (seal structures 82*a* and 82*b*) such that the foreign matter contained in the oil 1 is prevented from entering the guide portion 51 (52) as much as possible.

Figure 7:
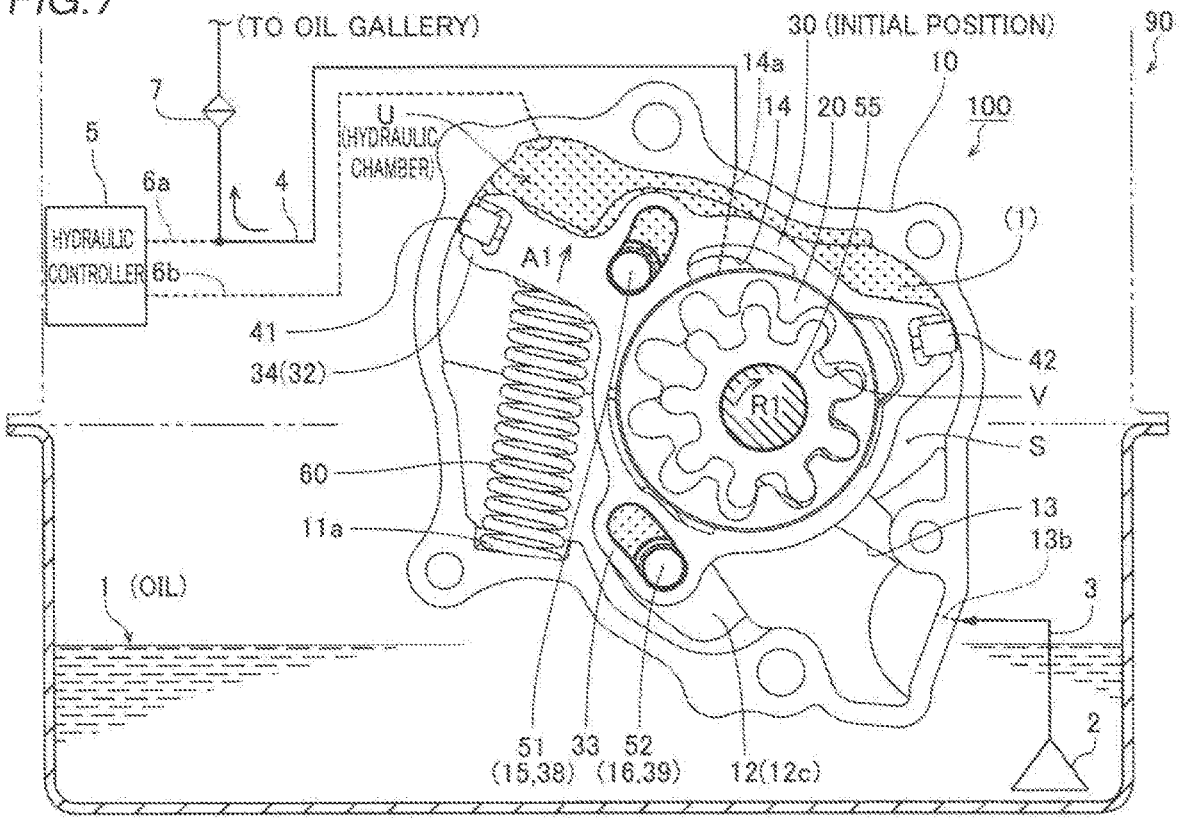
FIG. 7 A diagram showing the control state (initial position) of the variable oil pump according to the embodiment of the present invention.

As shown in FIG. 7, a hydraulic controller 5 that allows the variable displacement mechanism of the variable oil pump 100 to operate is provided in the discharge oil passage 4 of the engine 90. Specifically, the variable oil pump 100 and the hydraulic controller 5 are connected to each other by an oil passage 6*a* that branches from the discharge oil passage 4. The hydraulic controller 5 and the hydraulic chamber U in the housing 10 are connected to each other via an oil passage 6*b*. During driving of the variable oil pump 100, the hydraulic controller 5 operates based on a control signal from an ECU (not shown) mounted on the engine 90 such that the oil 1 delivered from the discharge oil passage 4 to the engine 90 (oil gallery) via an oil filter 7 (see FIG. 1) is partially drawn into the hydraulic controller 5 via the oil passage 6*a*, and then supplied to the hydraulic chamber U via the oil passage 6*b*.

Variable displacement control of the amount of the oil 1 discharged by the variable oil pump 100 is now described with reference to FIGS. 7 and 8.

(Description of Variable Displacement Control)

First, as shown in FIG. 7, the pump rotor 20 is driven in the arrow R1 direction by the input shaft 55 that rotates together with the start-up of the engine 90. At this time, the hydraulic controller 5 does not operate, and the adjustment ring 30 is held at the initial position reached when the adjustment ring 30 is maximally rotated in the arrow A1 direction due to the urging force of the coil spring 60. At the initial position, the suction port 13 faces a negative pressure action region where the pressure of the oil 1 is reduced between the external teeth 21*a* of the inner rotor 21 and the internal teeth 22*a* of the outer rotor 22, and the discharge port 14 faces a positive pressure action region where the oil 1 is compressed between the external teeth 21*a* of the inner rotor 21 and the internal teeth 22*a* of the outer rotor 22. Therefore, the oil 1 in the oil pan 91 is suctioned into the pump rotor 20 from the suction port 13 and is discharged from the discharge port 14 to the discharge oil passage 4 via the oil passage 14*a*.

Figure 8:
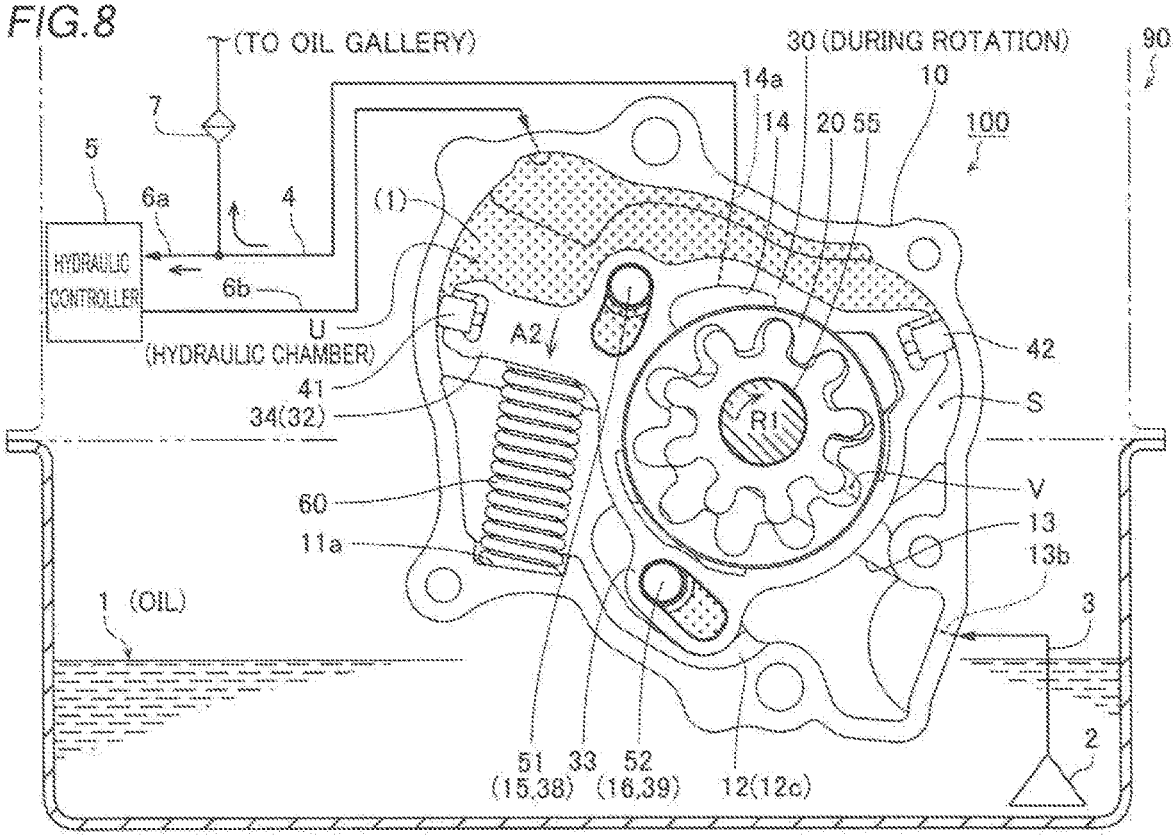
FIG. 8 A diagram showing the capacity control state of the variable oil pump according to the embodiment of the present invention.

Then, as shown in FIG. 8, the hydraulic controller 5 operates based on the control signal from the ECU (not shown) according to the rotational speed and load of the engine 90. That is, after the oil 1 from the suction port 13 is drawn into the hydraulic controller 5 via the oil passage 6*a*, the oil 1 is supplied to the hydraulic chamber U via the oil passage 6*b*. Then, the hydraulic pressure of the oil 1 supplied to the hydraulic chamber U acts on the operation portion 34 of the adjustment ring 30 such that the adjustment ring 30 starts to rotate in the arrow A2 direction from the initial position (see FIG. 7) against the urging force of the coil spring 60.

Together with the rotation of the adjustment ring 30 in the arrow A2 direction, the outer rotor 22 of the pump rotor 20 revolves in the arrow A2 direction while maintaining a predetermined amount of eccentricity with respect to the rotational center of the inner rotor 21 in a state where the internal teeth 22*a* mesh with the external teeth 21*a* of the inner rotor 21. Thus, the positive pressure action region and the negative pressure action region are moved about the rotational center of the inner rotor 21, and hence the negative pressure that acts on the suction port 13 from the negative pressure action region is reduced, and the positive pressure that acts on the discharge port 14 from the positive pressure action region is also reduced. Consequently, the amount (a supply to the engine 90) of the oil 1 discharged from the pump rotor 20 is reduced.

The ECU controls the operation of the hydraulic controller 5 in detail such that the hydraulic pressure (the urging force for urging the operation portion 34 in the arrow A2 direction) of the oil 1 supplied to the hydraulic chamber U is adjusted. Thus, the rotational position of the adjustment ring 30 is precisely adjusted according to the balance relationship between the hydraulic pressure of the hydraulic chamber U with respect to the operation portion 34 and the urging force (the urging force for urging the operation portion 34 in the arrow A1 direction) of the coil spring 60 with respect to the operation portion 34. In addition, the rotational position of the adjustment ring 30 is adjusted such that the amount of the oil 1 discharged by the variable oil pump 100 is controlled in detail. The variable oil pump 100 according to this embodiment is configured as described above.

Effects of Embodiment

According to this embodiment, the following effects can be obtained.

According to this embodiment, as hereinabove described, the seal structures 81 and 82 that seal the insides of the guide holes 38 and 39 with respect to the housing space S by surrounding the movement trajectories P1 and P2 of the guide holes 38 and 39 of the adjustment ring 30 relatively displaced with respect to the pins 15 and 16 are provided on the housing 10 and the cover 19. Thus, even when the foreign matter contained in the oil 1 flows into the variable oil pump 100 (the housing space S between the housing 10 and the cover 19) during operation of the variable oil pump 100, the inside of the guide hole (39) of the guide portion 51 (52) that holds the pin 15 (16) can be sealed with respect to the housing space S, and hence it is possible to prevent the foreign matter from entering the guide portion 51 (52) (guide hole 38 (39)). Consequently, the foreign matter is prevented from being trapped in the guide portion 51 (52) (guide hole 38 (39)), and hence it is possible to significantly reduce or prevent inhibition of the smooth operation (displacement) of the adjustment ring 30 due to the foreign matter that has flowed into the variable oil pump 100.

According to this embodiment, the seal structure 81 (82) is circumferentially provided on a portion of the sealing surface 12*d* (12*e*) corresponding to the movement trajectory P1 (P2) of the guide hole 38 (39) in the housing recess 12*c* of the housing 10. Thus, the inside of the guide hole 38 (39) of the guide portion 51 (52) can be continuously sealed with respect to the housing space S along the movement trajectory P1 (P2) of the guide hole 38 (39) of the adjustment ring 30, and hence it is possible to reliably prevent the foreign matter that has been mixed (has flowed) into the housing space S between the housing 10 and the cover 19 during operation of the variable oil pump 100 from entering the guide portion 51 (52) (the guide hole 38 (39) of the adjustment ring 30 during displacement).

According to this embodiment, the seal structure 81 (82) is circumferentially provided on the sealing surface 19*d* (19*e*) corresponding to the movement trajectory P1 (P2) of the guide hole 38 (39) in the inner bottom 19*c* of the cover 19 in addition to the sealing surface 12*d* (12*e*) of the housing 10. Thus, in addition to the sealing surface 12*d* (12*e*) of the housing 10, the sealing surface 19*d* (19*e*) of the cover 19 and the guide portion 51 (52) (guide hole (39)) can be further continuously sealed. Therefore, the sealing property (sealability) between the guide hole (39) and the housing space S can be increased on both the housing 10 side and the cover 19 side, and hence it is possible to more reliably prevent the foreign matter that has been mixed (has flowed) into the housing space S from entering the guide portion 51 (52) (guide hole 38 (39)).

According to this embodiment, the seal structure 81*a* (82*a*) on the cover 19 and the seal structure 81*b* (82*b*) on the housing 10 overlap each other with the same shape in a planar view. Thus, regardless of how the adjustment ring 30 is displaced (rotates), both the sealing property (sealability) between the guide portion 51 (52) (guide hole 38 (39)) and the housing 10 and the sealing property (sealability) between the guide portion 51 (52) (guide hole 38 (39)) and the cover 19 can be kept. Along with this, the adjustment ring 30 that is displaced (rotates) while being sandwiched between the sealing surface 12*d* (12*e*) and the sealing surface 19*d* (19*e*) can be securely held in the housing space S.

According to this embodiment, the seal structure 81*a* (82*a*) seals the inside of the guide hole 38 (39) with respect to the housing space S by bringing the flat sealing surface 19*d* (19*e*) of the cover 19 and the sealing surface 38*c* (39*c*) of the guide hole 38 (39) of the adjustment ring 30 into surface contact with each other. Furthermore, the seal structure 81*b* (82*b*) seals the inside of the guide hole 38 (39) with respect to the housing space S by bringing the flat sealing surface 12*d* (12*e*) of the housing 10 and the sealing surface 38*d* (39*d*) of the guide hole 38 (39) of the adjustment ring 30 into surface contact with each other. Thus, even when the outer edge 38*b* (39*b*) of the guide hole 38 (39) in the adjustment ring 30 moves in the arrow A1 (A2) direction together with the displacement (rotation) of the adjustment ring 30, the internal space of the guide hole 38 (39) can be reliably isolated from the housing space S by the seal structure 81*a* (82*a*) in which the sealing surface 19*d* (19*e*) and the sealing surface 38*c* (39*c*) come into surface contact with each other and the seal structure 81*b* (82*b*) in which the sealing surface 12*d* (12*e*) and the sealing surface 38*d* (39*d*) come into surface contact with each other, using a wider sealing area, unlike the case where the outer edge 38*b* (39*b*) of the guide hole 38 (39) in the adjustment ring 30 simply comes into line contact with the sealing surface 19*d* (19*e*) and the sealing surface 12*d* (12*e*). Therefore, it is possible to easily prevent the foreign matter in the housing space S between the housing 10 and the cover 19 from entering the guide portion 51 (52) (guide hole 38 (39)) during operation of the variable oil pump 100.

According to this embodiment, in the seal structure 81 (82), the flat sealing surface 19*d* (19*e*) of the cover 19 and the flat sealing surface 12*d* (12*e*) of the housing 10 surround the movement trajectory P1 (P2) of the guide hole 38 (39) while extending to the region outside the outer edge 38*b* (39*b*) of the guide hole 38 (39) in the adjustment ring 30. Thus, the sealing surface 38*c* (39*c*) of the guide hole 38 (39) can reliably come into surface contact with the sealing surface 19*d* (19*e*) of the cover 19, and the sealing surface 38*d* (39*d*) of the guide hole 38 (39) can reliably come into surface contact with the sealing surface 12*d* (12*e*) of the housing 10.

[Modifications]

The embodiment disclosed this time must be considered as illustrative in all points and not restrictive. The range of the present invention is shown not by the above description of the embodiment but by the scope of claims for patent, and all modifications within the meaning and range equivalent to the scope of claims for patent are further included.

For example, while the seal structure 81*a* (82*a*) is provided between the cover 19 and the adjustment ring 30, and the seal structure 81*b* (82*b*) is provided between the housing 10 and the adjustment ring 30 in the aforementioned embodiment, the present invention is not restricted to this. That is, the seal structure 81 or 82 may be provided only on one of the housing 10 and the cover 19.

While the sealing surface 19*d* (19*e*) of the cover 19 and the sealing surface 38*c* (39*c*) of the guide hole 38 (39) come into surface contact with each other, and the sealing surface 12*d* (12*e*) of the housing 10 and the sealing surface 38*d* (39*d*) of the guide hole 38 (39) come into surface contact with each other in the aforementioned embodiment, the present invention is not restricted to this. For example, the seal structure 81 (82) may be formed by forming an annular groove that extends along the movement trajectory P1 (P2) of the guide hole 38 (39) in a region where the sealing surface 19*d* (19*e*) and the sealing surface 38*c* (39*c*) face each other, and fitting a seal member such as an O-ring into this annular groove. Furthermore, the structure into which the seal member is fitted is also applicable to a region where the sealing surface 12*d* (12*e*) and the sealing surface 38*d* (39*d*) face each other.

While the present invention is applied to the variable oil pump 100 that supplies the oil 1 to the engine 90 in the aforementioned embodiment, the present invention is not restricted to this. For example, the present invention may be applied to an oil pump that supplies AT fluid to an automatic transmission (AT) that automatically switches a transmission gear ratio according to the rotational speed of an internal combustion engine. Alternatively, the present invention may be applied to an oil pump that supplies lubricating oil to a sliding portion in a continuously variable transmission (CVT) that can continuously and steplessly change a transmission gear ratio unlike the aforementioned AT (multistage transmission), or an oil pump that supplies power steering oil to a power steering that drives a steering.

While the variable oil pump 100 is mounted on the automobile including the engine 90 in the aforementioned embodiment, the present invention is not restricted to this. The present invention may be applied to a variable oil pump for an internal combustion engine mounted on equipment other than a vehicle (automobile). As the internal combustion engine, a gasoline engine, a diesel engine, a gas engine, etc. can be applied.

While the pump rotor 20 having a tooth profile in which the tooth width is narrowed and the tooth length is stretched radially outward as compared with external teeth of an inner rotor and internal teeth of an outer rotor in a common trochoid pump is applied in the aforementioned embodiment, the present invention is not restricted to this. That is, the present invention may be applied to a variable oil pump including an internal gear pump rotor in which the tooth profile of each of external teeth 21*a* and internal teeth 22*a* includes a trochoid curve or a cycloid curve.

DESCRIPTION OF REFERENCE NUMERALS

1: oil
10: housing (pump housing)
12*c*: housing recess (flat inner surface)
12*d*, 12*e*, 19*d*, 19*e*: sealing surface (region portion, flat inner surface)
15, 16: pin
19: cover
19*c*: inner bottom (flat inner surface)
20: pump rotor (oil pump rotor)

30: adjustment ring (adjustment member)
38, 39: guide hole (groove)
38*b*, 39*b*: outer edge
38*c*, 38*d*, 39*c*, 39*d*: sealing surface (outer edge of the groove)
51, 52: guide portion
60: coil spring
81, 81*a*, 81*b*, 82, 82*a*, 82*b*: seal structure
100: variable oil pump
S: housing space
P1, P2: movement trajectory

The invention claimed is:

1. A variable oil pump comprising:

a pump housing;

a cover that faces the pump housing;

an oil pump rotor rotationally driven while being housed in a housing space between the pump housing and the cover;

an adjustment member housed in the housing space and that adjusts an amount of oil discharged from the oil pump rotor by being displaced due to a drive force while rotatably holding the oil pump rotor from an outer peripheral side;

a guide portion including a groove provided in the adjustment member and a pin provided on the pump housing and that engages with the groove, and the guide portion that guides relative displacement of the adjustment member with respect to the pump housing by engaging the groove and the pin with each other;

a seal structure provided on at least one of the pump housing or the cover and that seas an inside of the groove with respect to the housing space by surrounding a movement trajectory of the groove of the adjustment member relatively displaced with respect to the pin; and an oil passage provided on one of the pump housing or the cover that has an adjacently disposed, direct communication relationship with the pin and oil disposed in one side of the groove flowingly moves through the oil passage and is disposed in another side of the groove when the pin and the groove move relative to each other.

2. The variable oil pump according to claim 1, wherein the seal structure is circumferentially provided on a region portion corresponding to the movement trajectory of the groove in an inner surface of the pump housing.

3. The variable oil pump according to claim 2, wherein the seal structure is circumferentially provided on a region portion corresponding to the movement trajectory of the groove in an inner surface of the cover in addition to the region portion of the pump housing.

4. The variable oil pump according to claim 3, wherein the seal structure on the pump housing and the seal structure on the cover overlap each other with a same shape in a planar view.

5. The variable oil pump according to claim 1, wherein the seal structure seals the inside of the groove with respect to the housing space by bringing a flat inner surface of at least one of the pump housing or the cover and an outer edge of the groove in the adjustment member into surface contact with each other.

6. The variable oil pump according to claim 1, wherein a flat inner surface of at least one of the pump housing or the cover surrounds the movement trajectory of the groove while extending to a region outside an outer edge of the groove in the adjustment member.

* * * * *